United States Patent [19]

Adams, Jr.

[11] 4,284,152

[45] Aug. 18, 1981

[54] PUMP IN CORE BREAKER CARRIER

[75] Inventor: James B. Adams, Jr., Lewisville, Tex.

[73] Assignee: Otis Engineering Corporation, Dallas, Tex.

[21] Appl. No.: 90,391

[22] Filed: Nov. 1, 1979

[51] Int. Cl.[3] ..... E21B 9/00

[52] U.S. Cl. ..... 175/257; 175/317; 166/212

[58] Field of Search ..... 175/257, 258, 260, 261, 175/267, 269, 247; 166/153, 212, 155, 120, 156, 136, 133

[56] References Cited

U.S. PATENT DOCUMENTS

| | | | |
|---|---|---|---|
| 1,833,134 | 11/1931 | Stokes | 175/267 |
| 2,799,479 | 7/1957 | Kammerer | 175/268 |
| 2,997,119 | 8/1961 | Goodwin | 175/267 |
| 3,169,592 | 2/1965 | Kammerer | 175/267 |
| 3,208,531 | 9/1965 | Tamplen | 166/125 |
| 3,339,647 | 9/1967 | Kammerer, Jr. | 175/268 |
| 3,635,295 | 1/1972 | Cobbs | 175/257 |
| 3,980,134 | 9/1976 | Amancharla | 166/317 |
| 4,133,386 | 1/1979 | Knox | 166/212 |

*Primary Examiner*—James A. Leppink
*Attorney, Agent, or Firm*—Thomas R. Felger

[57] ABSTRACT

A core breaker carrier for inserting and removing a core breaker from a drill bit. The carrier of the present invention eliminates the need for using wireline tools to install a core breaker within a drill bit. The core breaker carrier with core breaker attached can be inserted into the bore of the drill pipe at the well surface and pumped into the drill bit. Fluid pressure is used to anchor the carrier at a preselected location within the drill bit.

8 Claims, 7 Drawing Figures

PUMP IN CORE BREAKER CARRIER

BACKGROUND OF THE INVENTION

1. Field of the Invention

The present invention discloses a carrier for inserting and removing a core breaker through the bore of drill pipe. A portion of the carrier includes a locking mandrel to anchor the carrier at a preselected location within a drill bit.

2. Description of the Prior Art

U.S. Pat. No. 3,208,531 to J. W. Tamplen discloses a locking mandrel and landing nipple similar to those used in the present invention. The locking mandrel of U.S. Pat. No. 3,208,531 is installed and removed by conventional wireline techniques. Core breakers attached to locking mandrels as shown in U.S. Pat. No. 3,208,531 have been installed in and removed from drill bits by separate trips with wireline tools. The present invention eliminates the first wireline trip because the carrier of the present invention can be moved through the bore of drill pipe and anchored at a preselected location in the drill bit by fluid pressure.

U.S. Pat. No. 3,980,134 to Amareswar Amancharla discloses the use of frangible discs made from brittle glass. The frangible disc used in the present invention could be made from any material, glass, metal, or plastic, that has the desired rupture characteristics.

SUMMARY OF THE INVENTION

The present invention discloses a core breaker carrier comprising mandrel means having a longitudinal flow passage extending therethrough, means for engaging one end of the mandrel means with a fishing tool, means for engaging a core breaker to the opposite end of the mandrel means, a first portion of the mandrel means comprising a locking mandrel for releasably anchoring the carrier at a preselected location within a drill bit, and means for restricting fluid flow through the longitudinal flow passage until the fluid pressure therein exceeds a preselected value anchoring the carrier within the drill bit.

An object of the present invention is to provide a core breaker carrier which can be moved through the bore of a drill pipe string and can be anchored within a drill bit attached to the lower end of the string by restricting fluid flow through the carrier.

Another object of the present invention is to provide a core breaker carrier which does not significantly restrict the flow of drilling fluids through the bore of the drill pipe string after the carrier is anchored within the drill bit.

Still another object of the present invention is to provide a core breaker carrier which can be easily engaged by conventional wireline fishing tools and removed from the bore of a drill bit.

Other objects and advantages will be readily apparent to those skilled in the art after reading the written description and claims in conjunction with the attached drawings.

DESCRIPTION OF THE PREFERRED EMBODIMENTS

Figure 1:
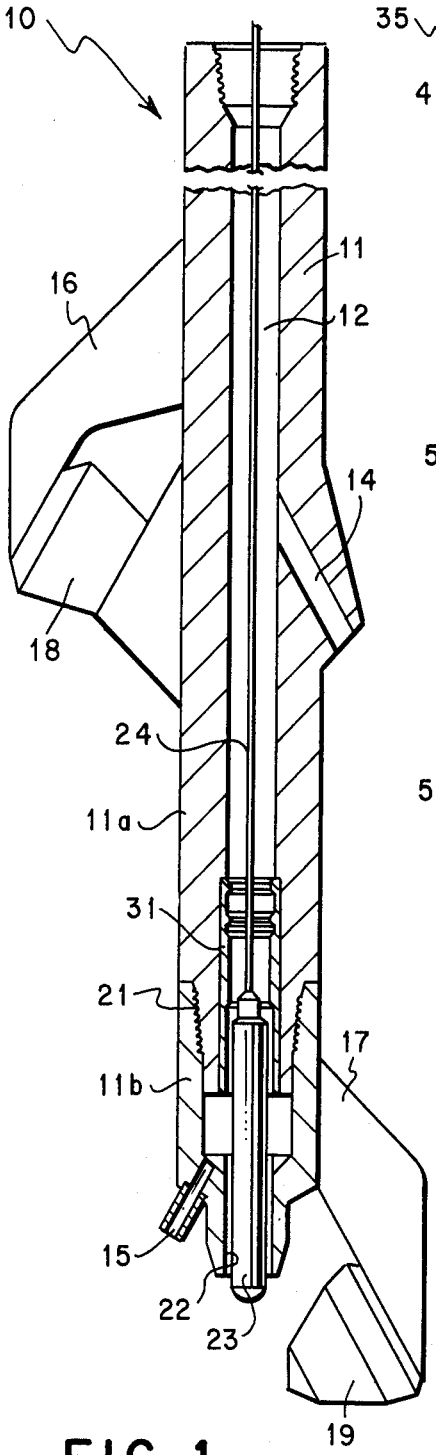
FIG. 1 is a schematic drawing, partially in elevation and partially in section, showing a drill bit adapted for use with the present invention.

Referring to the drawings and particularly FIG. 1, a schematic representation of drill bit 10 is shown. Bit 10 comprises a body 11 having a longitudinal bore 12 therethrough. Threads 13 are formed near the upper end of body 11 within bore 12 to provide a means for connecting drill bit 10 to a drill pipe string (not shown). Bore 12 would thus be aligned with and concentric to a matching bore in the drill pipe. Jet ports 14 and 15 communicate fluids from bore 12 to the exterior of body 11. Support members 16 and 17 are shown extending radially from body 11 with cutters 18 and 19 attached to each support member respectively. An actual drill bit would have multiple cutters 18 and 19.

Drill bit 10 can have various combinations of support members and cutters depending upon the drilling conditions for which it is designed. However, a jet port such as 14 and 15 is usually located to wash each cutter 18 and 19. The circulation of fluids from the well surface through the drill pipe string into bore 12 and out the jet ports is an important requirement for removing cuttings or debris and for controlling the well.

Body 11 consists of two sections **11*a* and 11*b* joined together by threads 21. Lower body section 11*b* has an opening 22 which is concentric with and as large as bore 12. As shown in FIG. 1, well tool 23 can be lowered by conventional wireline or electric line 24 through bore 12 and out opening 22. Well tool 23** could be various tools such as a bottom hole sampler, a pressure and/or temperature gauge, a television camera, or a sonic transducer. During various stages of the well drilling operation it may be desirable to lower one or more of these tools to the bottom of the well without having to pull the drill bit and pipe.

During normal drilling operations using a bit such as 10, if opening 22 were not plugged, a core would be formed within bore 12 by rotation of bit 10. To prevent bit 10 from forming such a core, core breaker 30 is normally secured within opening 22 while rotating bit 10. Landing nipple insert 31 is disposed within bore 12 to provide means for anchoring core breaker 30 within bit 10.

Landing nipple insert 31 could be of various designs well known in the oil and gas industry. One such design would be the landing nipple or housing disclosed in U.S. Pat. No. 3,208,531 to Jack W. Tamplen. U.S. Pat. No. 3,208,531 is incorporated by reference for all purposes. Core breakers similar to 30 have been installed in and removed from drill bits using conventional running tools and locking mandrels as taught in U.S. Pat. No. 3,208,531. However, these conventional techniques require a separate wireline trip to install core breaker 30 and to remove core breaker 30. The present invention requires a wireline trip only to remove core breaker 30.

Figure 2A:
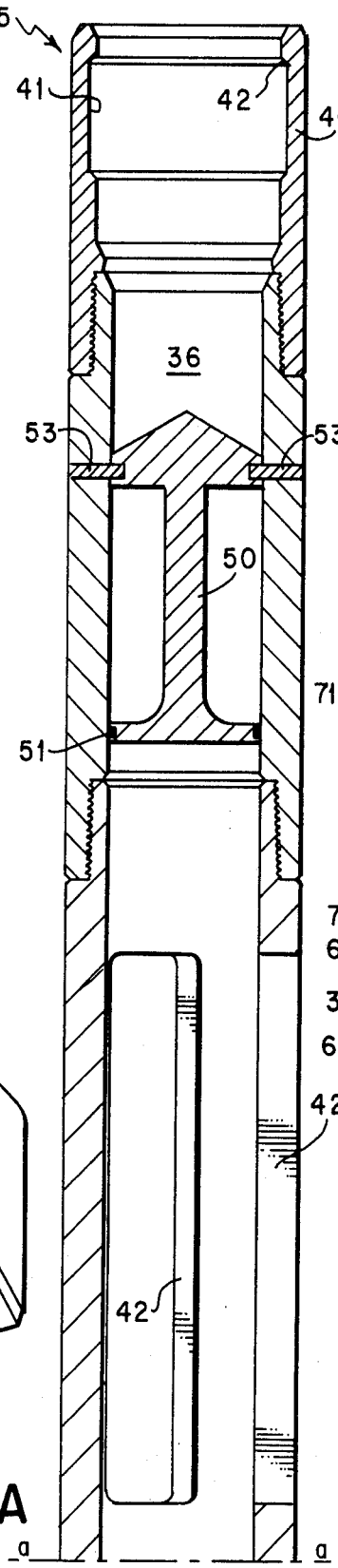
FIG. 2A is a drawing in section showing the upper portion of the carrier containing longitudinal slots.
Figure 2B:
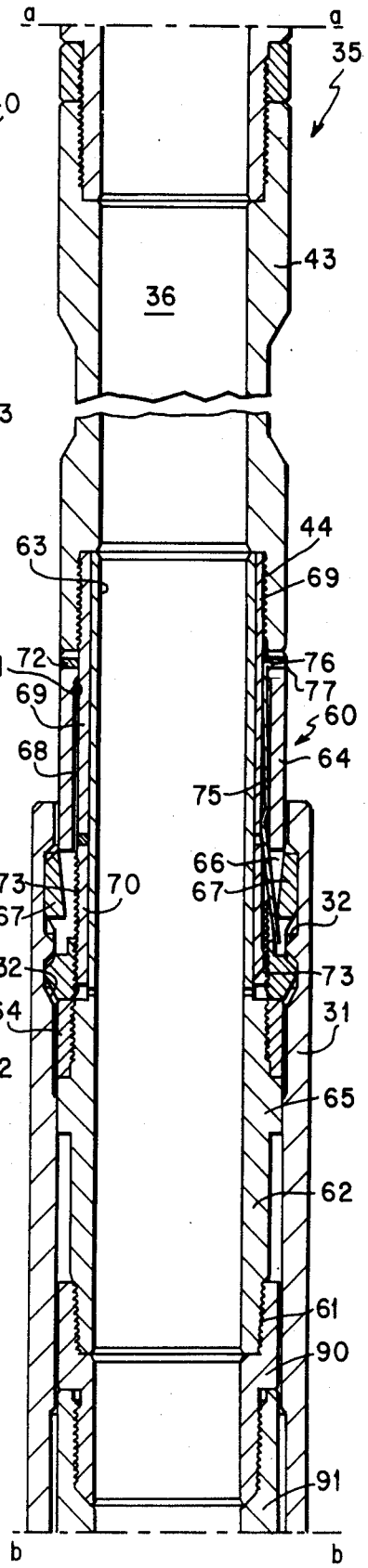
FIG. 2B is a drawing in section showing the locking mandrel portion of the carrier engaged with a landing nipple insert.
Figure 2C:
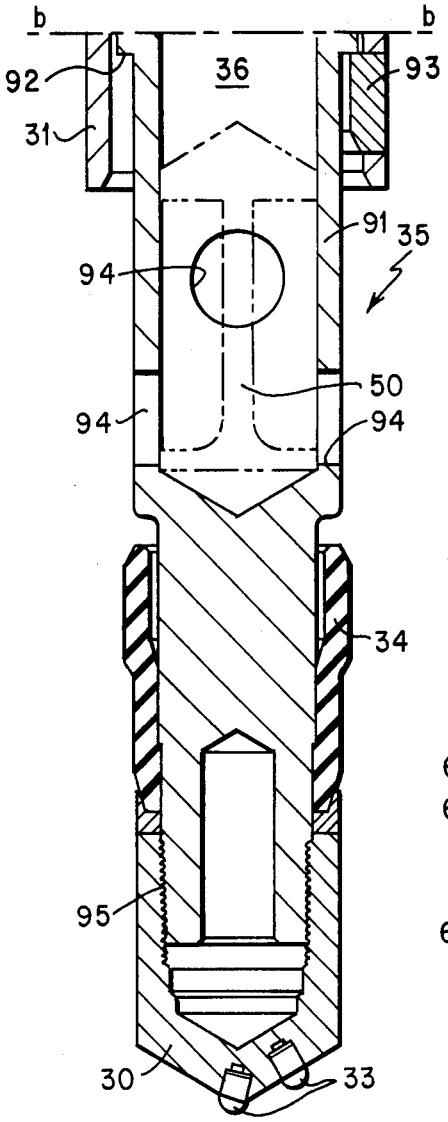
FIG. 2C is a drawing in section showing the core breaker attached to the lower portion of the carrier.

Referring generally to FIGS. 2A, 2B, and 2C, core breaker carrier 35 is shown secured within landing nipple insert 31. The various portions of carrier 35 are generally cylindrical and comprise a mandrel means having a longitudinal flow passage 36 therethrough.

The extreme upper end of carrier 35 comprises a fishing neck 40 having an enlarged inside diameter 41 and a downwardly facing shoulder 42. Fishing neck 40 can be engaged by conventional wireline pulling tools (not shown) to remove carrier 35 from insert 31.

Piston 50 is releasably secured in its first position within longitudinal flow passage 36 near fishing neck 40. Piston 50 is sized to be slidable within longitudinal flow passage 36. O-ring 51 is carried on the exterior of piston 50 in o-ring groove 52 and forms a fluid seal with the inside diameter of longitudinal flow passage 36 when piston 50 is in its first position. O-ring 51 could be replaced by a teflon ring or felt wiper. O-ring 51 can be omitted if pumps at the well surface can develop sufficient pressure differential across piston 50 despite fluid leakage there past. Shear pins 53 hold piston 50 in its first position until the fluid pressure within longitudinal flow passage 36 exceeds a preselected value. After pins 53 have been sheared, the fluid pressure can move piston 50 to its second position as shown by dotted lines in FIG. 2C. As will be explained later, piston 50 is designed to minimize restriction of fluid flow within longitudinal flow passage 36 when piston 50 is in its second position.

A portion of carrier 35 contains multiple longitudinal slots 42 which can communicate fluid between the exterior of carrier 35 and longitudinal flow passage 36. Slots 42 are spaced from shear pins 53 whereby piston 50 in its first position blocks fluid in passage 36 above piston 50 from communicating with slots 42.

The next portion of carrier 35 comprises a spacer mandrel 43. The length of spacer mandrel 43 is selected to align slots 42 with jet ports 14 when carrier 35 is anchored to insert 31. Spacer mandrels 43, in varying lengths, are available to allow the other portions of carrier 35 to be used with various sizes of drill bits.

Locking mandrel portion 60 of carrier 35 is attached to spacer mandrel 43 by threads 44. Locking mandrel 60 includes an elongated tubular mandrel 62. The inside diameter of mandrel 62 defines a portion of longitudinal flow passage 36. Threads 61 are formed on the lower end of mandrel 62 to connect the remaining portions of carrier 35 thereto. The upper section 63 of mandrel 62 has a substantially reduced outside diameter. A tubular dog carrying sleeve 64 is screw-threaded onto mandrel 62 and abuts flange 65.

Dog carrying sleeve 64 is provided with three radially spaced longitudinally extending lateral openings or windows 66 in which are disposed three laterally movable positioning and locking dogs 67. Each dog 67 has an exterior profile to conform to and engage with annular grooves 32 on the inside diameter of landing nipple insert 31. Dog carrier sleeve 64 has a bore which is larger than the outside diameter of upper section 63. Annular space 68 is formed therebetween. Elongate locking sleeve 69 is slidable over upper section 63 and telescopically received within annular space 68.

Figure 4:
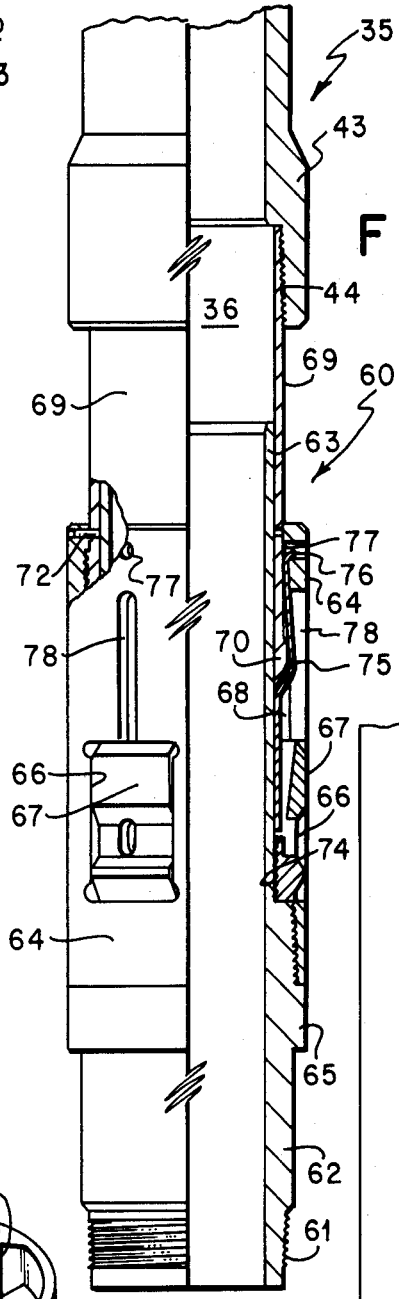
FIG. 4 is a drawing partially in section and partially in elevation showing the locking mandrel portion of the carrier prior to expanding the locking dogs to engage the landing nipple insert.

Locking sleeve 69 has an enlarged outside diameter at its lower end 70 which is sized to engage an internal annular flange 71 preventing upward displacement of locking sleeve 69 from annular space 68. When locking sleeve 69 is in its upper position as shown in FIG. 4, locking dogs 67 are movable laterally within windows 66. FIG. 4 shows the position of locking mandrel 60 when carrier 35 is being inserted through the bore of drill pipe by fluid pressure applied to piston 50. Locking mandrel 60 would be in substantially the same position when carrier 35 is being withdrawn through the bore of drill pipe, except pin 72 would be sheared and enlarged outside diameter 70 would be abutting flange 71.

Locking dogs 67 are substantially the same as those shown in U.S. Pat. No. 3,208,531. They are designed for limited radial extension through windows 66. Locking sleeve 69 can be telescoped within annular space 68 to project dogs 67. Enlarged outside diameter 70 positively holds dogs 67 radially projected into annular grooves 32. External serrations 73 formed on the enlarged outside diameter 70 of locking sleeve 69 are designed to engage corresponding serrations 74 formed on the inner surface of locking dogs 67.

Each elongate spring 75, which is substantially rectangular in cross-section, has a hook 76 at its upper end engaged in aperture 77 formed in the wall of dog carrying sleeve 64. Springs 75 extend downwardly between dog carrying sleeve 64 and locking sleeve 69. The upper portion of each spring 75 is confined within a narrow slot 78 in the wall of dog carrying sleeve 64. Narrow slots 78 extend upward from windows 66. The lower end of springs 75 engages locking dogs 67 respectively and biases dogs 67 inwardly to their retracted position as shown in FIG. 4.

Adapter sub 90 connects locking mandrel 60 to the lower mandrel portion 91 of carrier 35. Mandrel portion 91 has a downwardly facing shoulder 92 formed on its outside diameter. Three separate bosses 93 are positioned within the lower end of landing nipple insert 31 and project inwardly. Each boss 93 has an upwardly facing shoulder which is sized to engage shoulder 92. Bosses 93 and shoulder 92 are sized to prevent carrier 35 from moving completely through insert 31. When shoulder 92 is resting on bosses 93, dogs 67 are positioned adjacent to annular grooves 32. Lower mandrel portion 91 is sometimes considered a part of core breaker 30 with adapter sub 90 defining the division between carrier 35 and core breaker 30.

Longitudinal flow passage 36 terminates within lower mandrel portion 91. Lateral ports 94 penetrate the wall of mandrel portion 91 and communicate fluids between passage 36 and the exterior of carrier 35. The end of passage 36 within portion 91 provides a resting place for piston 50 as shown by dotted lines in FIG. 2C.

A core breaker 30 is screw-threaded to the lower end of mandrel portion 91 at threads 95. Core breaker 30 includes hard inserts 33 formed from carbide, tungsten, or diamonds to aid in drilling. An elastomeric packing element 34 is attached to the exterior of mandrel portion 91 immediately above core breaker 30. Packing element 34 is radially flexible and can form a fluid tight seal with opening 22 when carrier 35 is anchored to landing nipple insert 31. Thus, when core breaker carrier 35 and core breaker 30 are installed within drill bit 10, fluid flow is directed from the bore 12 out through jet ports 14 and 15 rather than opening 22.

Figure 3:
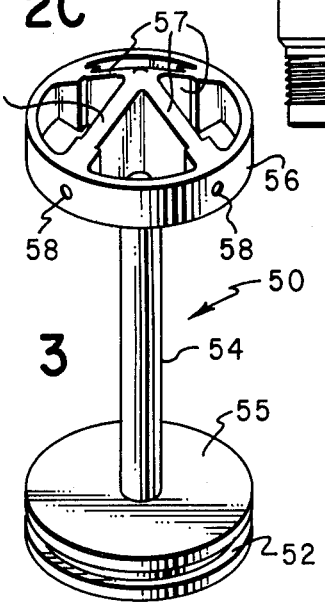
FIG. 3 is an isometric drawing in elevation of the piston on which fluid pressure acts to move the carrier through the bore of drill pipe and to anchor the carrier within the drill bit.

The means for restricting flow through longitudinal flow passage 36 includes piston 50 shown in FIG. 3.

Piston 50 comprises a rod 54 with a solid disc 55 attached to one end. O-ring groove 52 is formed in the outer circumference of disc 55. As previously noted above, when piston 50 is in its first position, o-ring 51 blocks fluid flow through longitudinal flow passage 36. A short cylinder 56 is attached to the opposite end of rod 54 by four radially spaced support arms 57. Support arms 57 meet at a point giving piston 50 the general appearance of a dart. Shear pin holes 58 are formed in the outer circumference of cylinder 58 to provide part of the means for releasably securing piston 50 within passage 36. When piston 50 is in its first position and fluid pressure in passage 36 above piston 50 exceeds a preselected value, pins 53 will shear allowing piston 50 to move to its second position at the bottom of passage 36. Disc 55 rests on the bottom of passage 36 when piston 50 is in its second position. Drilling fluids can flow from the bore of the drill pipe into longitudinal flow passsage 36 through cylinder 56 and the space between support arms 57 out through lateral ports 94 and then through jet ports 15 when piston 50 is in its second position.

Figure 5:
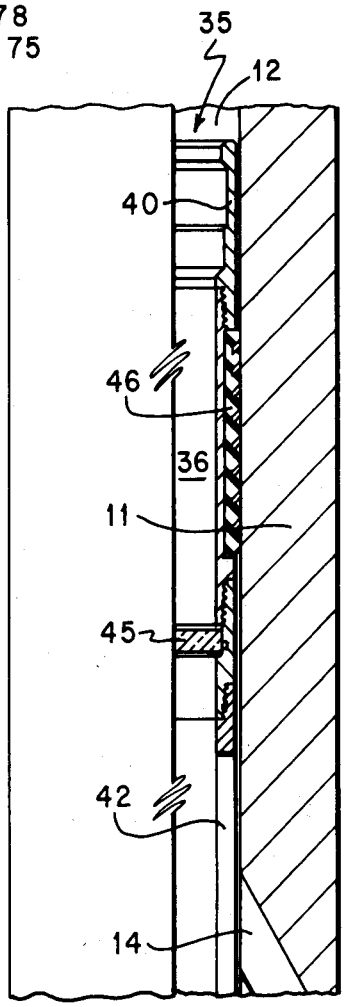
FIG. 5 is a schematic drawing partially in section and partially in elevation showing a portion of a drill bit and carrier having alternative means for moving the carrier through the bore of drill pipe.

An alternative means for restricting flow through longitudinal flow passage 36 is shown in FIG. 5. Drill bit body 11 is partially shown with carrier 35 anchored therein. Longitudinal slots 42 are adjacent to and communicating with jet ports 14.

Piston 50 of the previous embodiment has been replaced by frangible closure plate or disc 45. U.S. Pat. No. 3,980,134 to Amareswar Amancharla discloses the use of frangible discs in well tools. U.S. Pat. No. 3,980,134 is adopted by reference for all purposes in this application. Frangible disc 45 is secured within longitudinal flow passage 36 between fishing neck 40 and slots 42. Frangible disc 45 restricts fluid flow through passage 36 until the fluid pressure above disc 45 exceeds a preselected value and ruptures disc 45.

Elastomeric sealing elements 46 can be attached to the exterior of carrier 35 immediately below fishing neck 40. Sealing elements 46 can engage the wall of drill pipe while carrier 35 is being pumped down to drill bit 10 and prevent fluid from bypassing carrier 35. Also, sealing elements 46 can engage the inner wall bore 12 to direct fluids through longitudinal flow passage 36 when carrier 35 is anchored to landing nipple insert 31. Sealing elements 46 can be used in conjunction with either piston 50 or disc 45 depending upon pump capacity at the well surface.

Operating Sequence

Drill bit 10 is normally attached to a string of drill pipe (not shown). Well tool 23 can be lowered by conventional wireline techniques through opening 22 to perform any desired evolution such as measure bottom hole pressure and temperature or obtain a fluid sample. After the evolution is completed, tool 23 is removed and carrier 35 with core breaker 30 attached can be inserted into the bore of the drill pipe at the well surface. Fluid pressure can be applied by pumps above carrier 35. Since either piston 50 or frangible disc 45 restricts fluid flow through longitudinal flow passage 36, the fluid pressure will pump carrier 35 down the drill pipe and into bore 12. Shear pin 72 prevents premature setting of locking mandrel 60 if carrier 35 encounters a small restriction within the drill pipe.

Carrier 35 is pumped through body 11 until shoulder 92 engages bosses 93 which acts as a no-go preventing further downward movement of carrier 35. As previously noted, dogs 67 are adjacent to and aligned with grooves 32 when shoulder 92 rests on bosses 93. Increased fluid pressure above carrier 35 will cause pin 72 to shear. The shear value of pin 72 is preselected to be less than the pressure required to shear pin 53 holding piston 50 in its first position or to rupture frangible disc 45.

After pin 72 is sheared, increased fluid pressure on either piston 50 or frangible disc 45 causes locking sleeve 69 to telescope relative to elongated tubular mandrel 62 and sleeve 64 locking dogs 67 into grooves 30. This movement anchors carrier 35 within landing nipple insert 31 as shown in FIG. 2B. Relative movement of the various components of carrier 35 then stops, and increased fluid pressure will move piston 50 to its second position or rupture frangible disc 45. Normal drilling operations can then be resumed with drilling fluids flowing through passage 36 and out jet ports 14 and 15. Whenever it is desired to conduct another evolution through opening 22, normal drilling operations are stopped. A conventional wireline tool string (not shown) can be run through the bore of the drill pipe, engage fishing neck 40, and remove core breaker carrier 35 and core breaker 30 from drill bit 10.

This written description is illustrative of only two embodiments of the present invention. Changes and modifications will be readily apparent to those skilled in the art and may be made without departing from the scope of the invention which is defined in the claims.

What is claimed is:

1. A core breaker carrier, comprising:

a. mandrel means having a longitudinal flow passage extending therethrough;

b. means for engaging one end of the mandrel means with a fishing tool;

c. means for engaging a core breaker to the opposite end of the mandrel means;

d. a first portion of the mandrel means comprising a locking mandrel for releasably anchoring the carrier at a preselected location within a drill bit;

e. means for restricting fluid flow through the longitudinal flow passage until the fluid pressure therein exceeds a preselected value anchoring the carrier within the drill bit;

f. the flow restricting means further comprising a piston having a first position releasably secured within the longitudinal flow passage near the one end of the mandrel means;

g. the piston having a second position near the opposite end of the mandrel means; and h. lateral ports extending through the mandrel means to communicate fluid between the longitudinal flow passage and the exterior of the mandrel means when the piston is in its second position.

2. A core breaker carrier as defined in claim 1, wherein the mandrel means further comprises a second portion having longitudinal slots allowing fluid to communicate between the longitudinal flow passage and the exterior of the mandrel means.

3. A core breaker carrier as defined in claim 2, wherein the mandrel means further comprises a spacer mandrel between the first mandrel portion and the second mandrel portion.

4. A core breaker carrier as defined in claim 1, wherein the piston further comprises:

a. a rod;

b. a solid disc attached to one end of the rod;

c. a groove formed in the outside diameter of the disc;

d. a cylinder attached to the opposite end of the rod by support arms;

e. the support arms being spaced radially from each other to allow fluid communication through the cylinder; and f. means for releasably securing the cylinder to the inside diameter of the longitudinal flow passage when the piston is in is first position.

5. A core breaker carrier, comprising:

a. mandrel means having a longitudinal flow passage extending therethrough;

b. means for engaging one end of the mandrel means with a fishing tool;

c. means for engaging a core breaker to the opposite end of the mandrel means;

d. a first portion of the mandrel means comprising a locking mandrel for releasably anchoring the carrier at a preselected location within a drill bit;

e. means for restricting fluid flow through the longitudinal flow passage until the fluid pressure therein exceeds a preselected value anchoring the carrier within the drill bit; and f. the flow restricting means further comprising a frangible disc secured within the longitudinal flow passage.

6. A core breaker carrier as defined in claims 4 or 5, wherein the fluid restricting means further comprises elastomeric sealing elements attached to the exterior of the mandrel means near the one end thereof.

7. A core breaker carrier, comprising:

a. mandrel means having a longitudinal flow passage extending therethrough;

b. a fishing neck formed on one end of the mandrel means;

c. means for engaging a core breaker to the opposite end of the mandrel means;

d. a first portion of the mandrel means comprising a locking mandrel for releasably anchoring the carrier at a preselected location within a drill bit;

e. means for restricting fluid flow through the longitudinal flow passage until the fluid pressure therein exceeds a preselected value;

f. the flow restricting means comprising a piston having a first position releasably secured within the longitudinal flow passage near the one end of the mandrel means;

g. seal means, carried on the piston, forming a fluid seal with the inside diameter of the longitudinal flow passage when the piston is in its first position;

h. the piston resting at a second position near the opposite end of the mandrel means when released from its first position; and i. lateral ports extending through the mandrel means to communicate fluid between the longitudinal flow passage and the exterior of the mandrel means.

8. A core breaker carrier as defined in claim 7, wherein the piston further comprises:

a. a rod;

b. a solid disc attached to one end of the rod;

c. an o-ring groove formed in the outside diameter of the disc;

d. a cylinder attached to the opposite end of the rod by support arms;

e. the support arms being spaced radially from each other to allow fluid communication through the cylinder; and f. shear pins securing the cylinder to the inside diameter of the longitudinal flow passage when the piston is in its first position.

* * * * *